US005778622A

United States Patent [19]

Baker

[11] Patent Number: 5,778,622

[45] Date of Patent: Jul. 14, 1998

[54] EARTH STABILIZATION STRUCTURE AND METHOD FOR MAKING AND USING THEREOF

[76] Inventor: DeLoy T. Baker, P.O. Box 69 776 Jordan Creek Rd., Falling Rock, W. Va. 25079

[21] Appl. No.: 870,947

[22] Filed: Jun. 6, 1997

[51] Int. Cl.[6] ..... E04C 1/41

[52] U.S. Cl. ..... 52/405.3; 52/DIG. 9; 52/405.1; 52/745.2; 52/747.12; 52/601; 52/606; 52/608; 405/286; 405/15; 428/903.3; 47/83; 264/275; 264/279.1

[58] Field of Search ..... 52/DIG. 9, 745.2, 52/747.12, 405.1, 405.3, 601, 606, 608, 583.1; 405/15–17, 258, 284, 286; 264/262, 263, 271.1, 275, 279.1; 428/903.3; 47/83

[56] References Cited

U.S. PATENT DOCUMENTS

| | | | |
|---|---|---|---|
| 3,555,763 | 1/1971 | Bloxom | 52/601 X |
| 3,842,606 | 10/1974 | Stiles et al. . | |
| 4,057,141 | 11/1977 | Lauire et al. | 52/DIG. 9 X |
| 4,080,793 | 3/1978 | Pulsifer . | |
| 4,139,319 | 2/1979 | Anderson . | |
| 4,288,175 | 9/1981 | Baker et al. . | |
| 4,320,606 | 3/1982 | GangaRao | 52/125 |
| 4,658,541 | 4/1987 | Haile . | |
| 4,724,649 | 2/1988 | Lowndes | 52/583.1 |
| 4,785,577 | 11/1988 | Lederbauer . | |
| 4,804,294 | 2/1989 | Barthel . | |
| 4,997,309 | 3/1991 | Kiselewski . | |
| 5,092,076 | 3/1992 | Terreta . | |
| 5,103,616 | 4/1992 | Nordberg . | |
| 5,172,528 | 12/1992 | Clarke . | |
| 5,214,897 | 6/1993 | Nordberg . | |
| 5,236,756 | 8/1993 | Halliburton | 428/903.3 X |
| 5,370,475 | 12/1994 | LeBlanc . | |
| 5,378,088 | 1/1995 | Foehrkolb . | |
| 5,380,124 | 1/1995 | Cacossa et al. . | |
| 5,400,561 | 3/1995 | Metten . | |

*Primary Examiner*—Robert Canfield
*Attorney, Agent, or Firm*—Robert N. Blackmon

[57] ABSTRACT

An earth stabilization structure and methods for making and using thereof are provided. The structure comprises a compressed annular tire wall stack unit encased in a reinforced matrix shell. The structure is preferably octagonal and cross-sectioned and preferably have a hollow core. The structure has welding elements for fixedly attaching adjacent structures together in the form of weld elements from any adjacent structures to be welded together. A stabilization wall is also provided by rigidly attaching a plurality obstructors together using the weld elements. The method involves providing a mold having a central pipe, compacting a plurality of tire sidewalls to provide a compacted annular tire wall stack unit (bundle), placing the bundle over the pipe, placing weld elements at the bottom of the mold, placing concrete in the mold, permitting the concrete to solidify, and removing the resultant structure from the mold. The structures may be utilized by placing structures in a dirt mass and rigidly attaching adjacent structures to each other to produce the final wall.

6 Claims, 5 Drawing Sheets

EARTH STABILIZATION STRUCTURE AND METHOD FOR MAKING AND USING THEREOF

BACKGROUND OF THE INVENTION

1. Field of the Invention

The present invention relates to concrete structures and methods for making and using thereof, and more particular relates to concrete structures, concrete walls, methods for making and using thereof for erosion control.

2. Description of the Related Art

Various concrete structures have been disclosed for use in controlling erosion, and some of these structures have employed used tires as a component thereof. Prior concrete structures utilizing tires have usually suffered from one or more of the following problems or disadvantages: (1) low tire usage, (2) risk of slippage and movement during use on inclined dirt banks, and/or (3) inefficient stackability. Examples of prior concrete systems include Kiselewski U.S. Pat. No. 4,997,309 issued Mar. 5, 1991 which discloses a concrete clad tire log which involves providing a plurality of used tires which are made into a form by placing them in side wall to side wall contact and filling the form with concrete to produce a tire clad concrete log which may have a reinforcing rod and which may be placed on an ocean floor to break wave action; Anderson U.S. Pat. No. 4,139,319 issued Feb. 13, 1979 which discloses a monolithical revetment made of motor vehicle rubber tires and concrete; Norverg U.S. Pat. No. 5,103,616 issued Apr. 14, 1992 which discloses a method and container for encapsulating tires involving encapsulating a compacted bundle of tires and forming a cube of concrete having a hole; Clarke U.S. Pat. No. 5,172,528 issued Dec. 22, 1992 which discloses a building construction incorporating recycled tires which have been in the form of compacted bales; Norverg U.S. Pat. No. 5,214,897 issued Jun. 1, 1993 which discloses a concrete block having a compacted bundle of tires encased in concrete; Pulsifer U.S. Pat. No. 4,080,793 issued Mar. 28, 1978 which discloses a method and apparatus for using automotive tires as earth engineering devices; Lederbauer U.S. Pat. No. 4,785,573 issued Nov. 22, 1988 which discloses a noise-absorbing greenery carrying structure made of worn tires; Haile U.S. Pat. No. 4,658,541 issued Apr. 21, 1987 which discloses interlocking planters; Barthel U.S. Pat. No. 4,804,294 issued Feb. 14, 1989 which discloses a method and means for erosion control; Cacossa, et al. U.S. Pat. No. 5,380,124 issued Jan. 10, 1995 which discloses a beach stabilizer; Foehrkolb U.S. Pat. No. 5,378,088 issued Jan. 3, 1995 which discloses a retaining wall made using segmented automobile tires; Lebanc U.S. Pat. No. 5,370,475 issued Dec. 6, 1994 which discloses an erosion barrier system made from tires; Baker, et al. U.S. Pat. No. 4,288,175 issued Sep. 8, 1981 which discloses earthen dams; Styles, et al. U.S. Pat. No. 3,842,606 issued Oct. 22, 1974 which discloses beach protectors made from used tires; Metten U.S. Pat. No. 5,400,561 issued Mar. 28, 1995 which discloses concrete blocks having water drainage holes; and Terreta U.S. Pat. No. 5,092,076 which discloses a planter edging landscape system. Each of these systems suffers from one or more of the above problems or disadvantages, consequently they either make relatively low or no use of used tires, may be subject to slippage if used in erosion control and/or may not be efficiently and fixedly stackable. Consequently, there is a need and a desire to provide earth stabilization structures and methods for making and using thereof which will provide for high content levels of used tire usage, efficiently stackable features, and slip resistant rigidly affixed interrelating characteristics.

SUMMARY OF THE INVENTION

An earth stabilization structure and methods for making and using thereof are provided. The structure comprises a compressed annular tire wall stack unit encased in a reinforced matrix shell. The structure is preferably octagonal in cross-section and preferably has a hollow core. The structure has means for fixedly attaching adjacent structures together in the form of weld elements which permit any adjacent structures to be welded together. A stabilization wall is also provided by rigidly attaching a plurality of structures together using the weld elements. The method involves providing a mold having a central pipe, compacting a plurality of tire sidewalls to provide a compacted annular tire wall stack unit (bundle), placing the bundle over the pipe, placing weld elements at the bottom, top and sides of the mold, placing concrete in the mold, permitting the concrete to solidify, and removing the resultant structure from the mold. The structures may be utilized by placing structures in a dirt mass and rigidly attaching adjacent structures to each other to provide the desired final wall.

BRIEF DESCRIPTION OF THE INVENTION

DETAILED DESCRIPTION OF THE INVENTION

Figure 1:
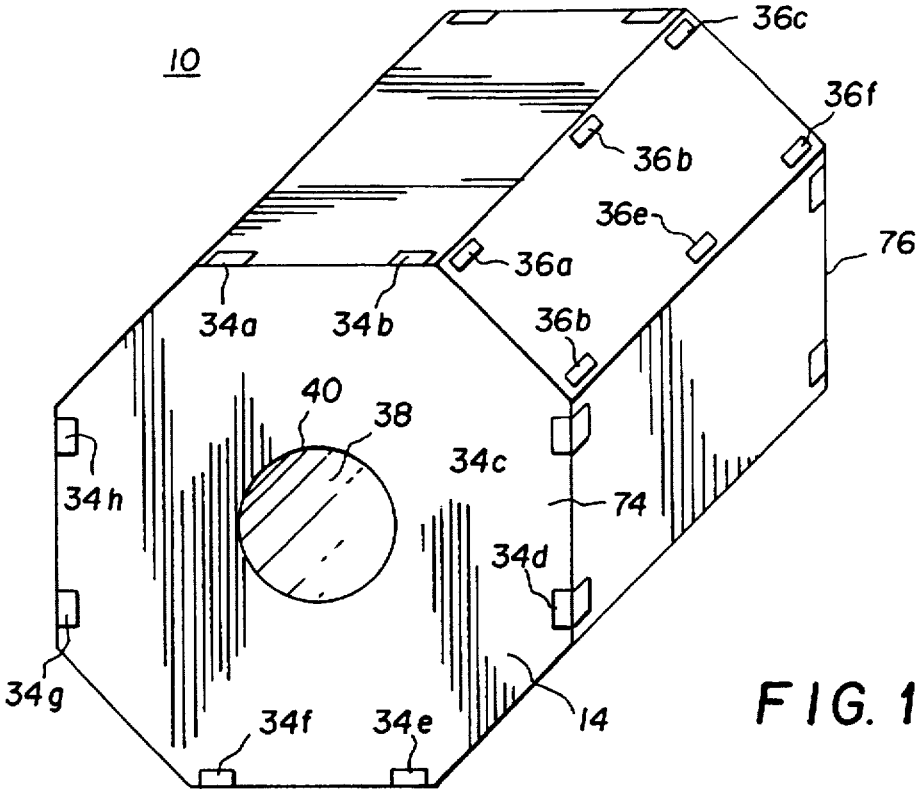
FIG. 1 is a prospective view showing the reinforced earth stabilization structure of the present invention.
Figure 3:
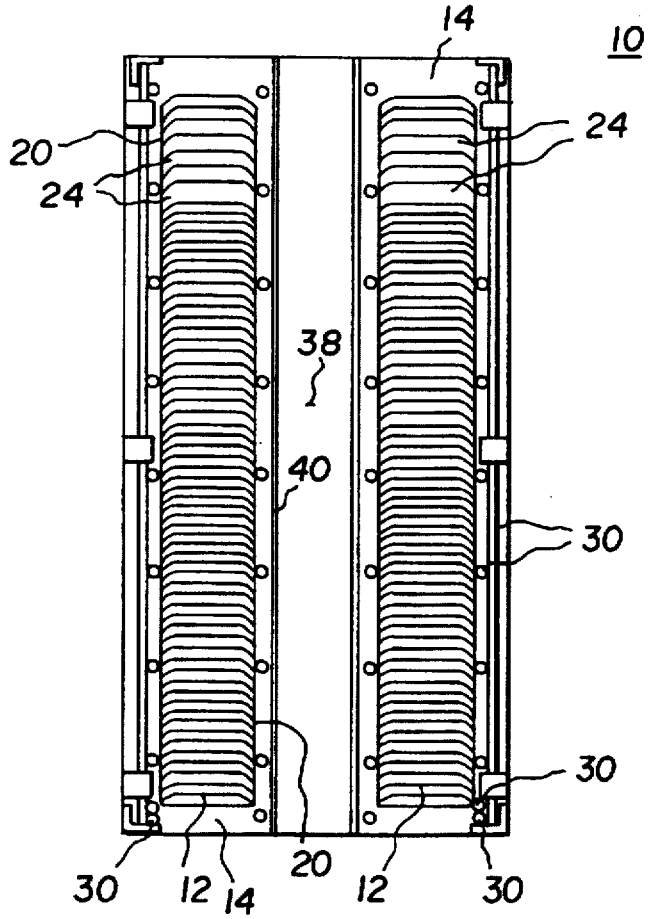
FIG. 3 is a vertical cross-sectional view of a structure according to the present invention.

As best shown in FIGS. 1 and 3, a reinforced earth stabilization structure (10) is provided comprising an annular tire wall stack unit (bundle) (12) encased in a reinforced concrete matrix shell (14). Optionally, a plurality of bundles may be used to form the unit (12). For a forty eight inch high mold, a forty two inch high bundle is suitably used to provide three inches of concrete at the top and bottom of the resultant structure. A forty eight inch high bundle will typically have about 56 tire halves. The tire halves are preferably made suitable for compression and bundling by making cuts (16) transverse to the tread to permit the tread section to be compressed to a substantially planar orientation relative to the sidewall of the tire (rather than the tire half having the conventional cup shape). The tire halves are produced by cutting the tire in half down the middle of the tread. In producing the bundle (12), a plurality of respective tire sidewalls (24) are stacked and compressed such as by hydraulic ram force, and are banded in a stacked position using rebar (band, bands) (20). Preferably the structure (10) is a reinforced structure utilizing concrete wire mesh (28) and reinforcement bar (30) which may be oriented within the concrete matrix either horizontally and/or vertically as desired.

Figure 4:
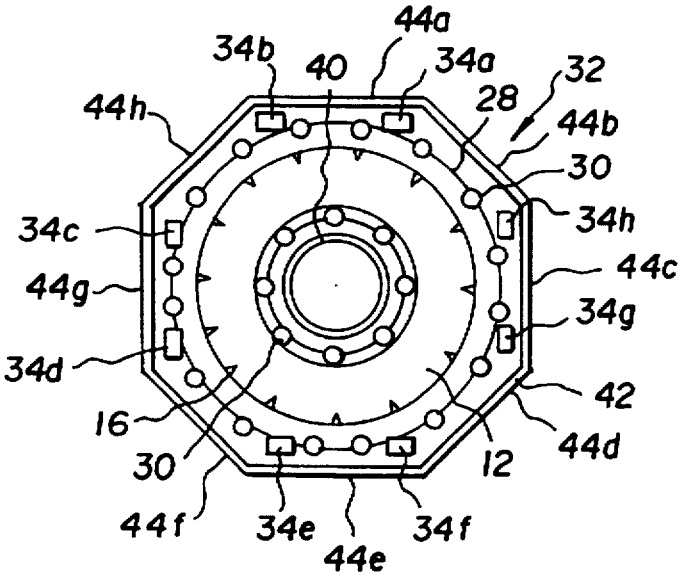
FIG. 4 is a top plan view of a mold according to the present invention having an annular tire wall stack unit positioned therein.
Figure 5:
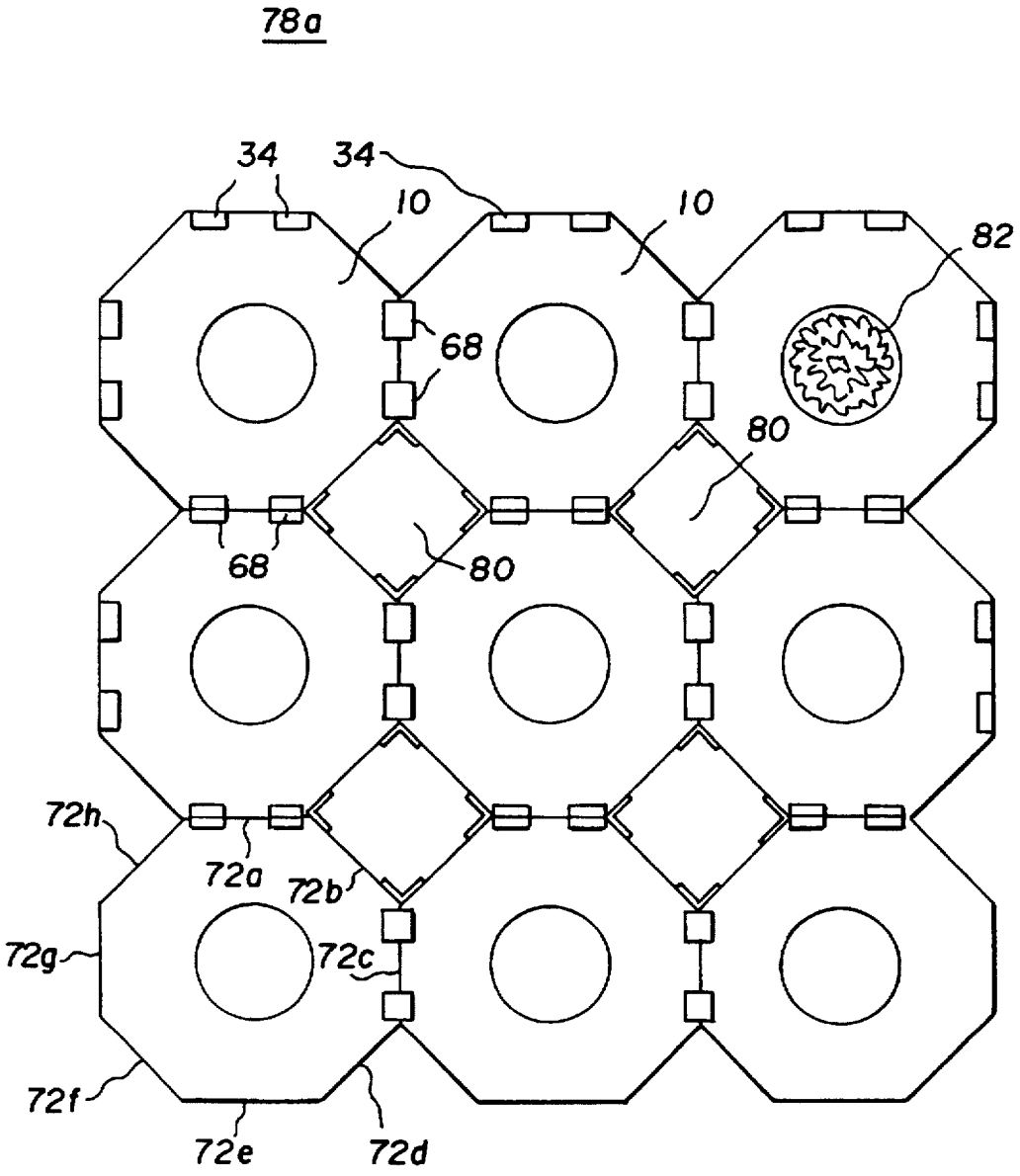
FIG. 5 is a top plan view of a stair step wall (honeycomb formation) according to present invention.

In making the structure (10) a mold (32) as best shown in FIG. 4 is utilized. Weld elements (34*a–h*) are positioned within the mold (32) to provide a final structure (10) as shown in FIG. 1 with weld elements located along the top (74). Weld elements are also placed in the mold to provide weld elements at the bottom (76) of the structure. Optionally weld elements (36*a–f*) may also be utilized so that the structure has the weld elements (36*a,b,c,d,e,f*) on at least one side (72) thereof.

The structure (10) preferably has a hollow core (38) formed by a pipe (40) for permitting the growing of vegetation therethrough. The hollow core (38) is provided by the mold having a central pipe (40) such as black corrugated drain pipe. The mold (32) has a outer mold wall (42) which has a plurality of wall sections (44*a–h*).

Figure 8:
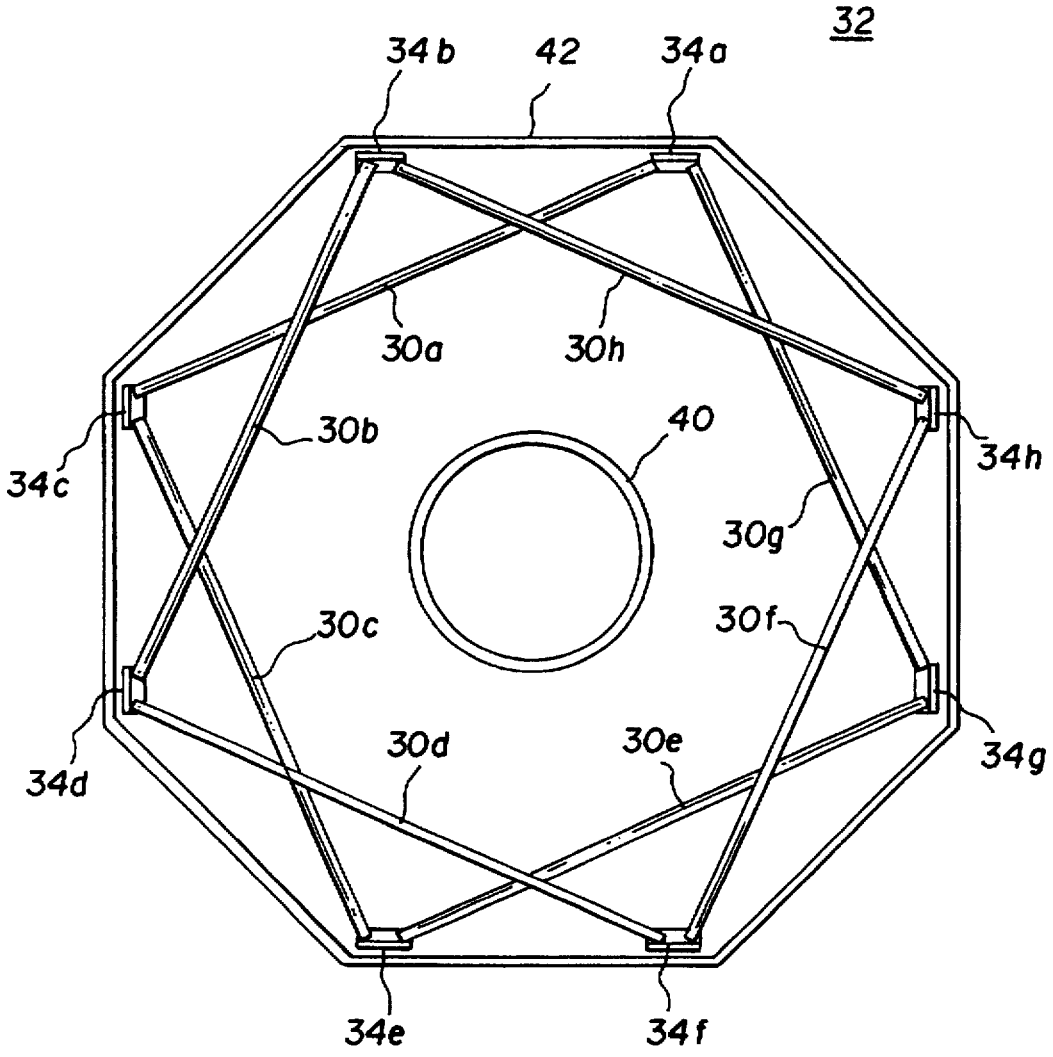
FIG. 8 is a top plan view of angle iron tabs welded to reinforcement bar and positioned within the mold of the present invention.

In use of the mold (32), a (annular) bundle (12) is positioned over (received by) the pipe (40) and reinforcement bar (30) and concrete wire mesh (28) are positioned around the bundle (12) and within the mold (32). Wet fluid concrete is then poured into the mold and encases the bundle (12) and the reinforcement bar (30) and the concrete wire mesh (28). Prior to filling the mold with the fluid concrete, weld elements (34*a–h*) for the bottom of the structure (10) are positioned within the mold, and preferably are in the form of angle iron for partially being embedded in the concrete and partially exposed for welding thereto during use and formation of a concrete wall (78). The weld elements (34*a–h*) in the form of angle irons are preferably secured to reinforcement bar (30) for the strengthening thereof. As best shown in FIG. 8, reinforcement bars are preferably arranged in the form of two squares to secure the weld elements (34*a–h*), for example a reinforcement bar (30*a*) may extend from weld element (34*a*) to weld element (34*c*), reinforcement bar (30*c*) extends from weld element (34*c*) to weld element (34*e*), reinforcement bar (30*e*) extends from weld element (34*e*) to weld element (34*g*), reinforcement bar (30*g*) extends from weld element (34*g*) to weld element (34*a*), and the resultant reinforcement bars (30*a,c, e,g*) form a substantially square reinforcement pattern. Reinforcement bar (30*b*) extends from weld element (34*b*) to weld element (34*d*), reinforcement bar (30*d*) extends from weld element (34*d*) to weld element (34*f*), reinforcement bar (30*f*) extends from weld element (34*f*) to weld element (34*h*), reinforcement bar (30*h*) extends from weld element (34*h*) to weld element (34*b*). The resultant reinforcement bars (30*b,d,f,h*) provide a substantially square reinforcement pattern.

Figure 2:
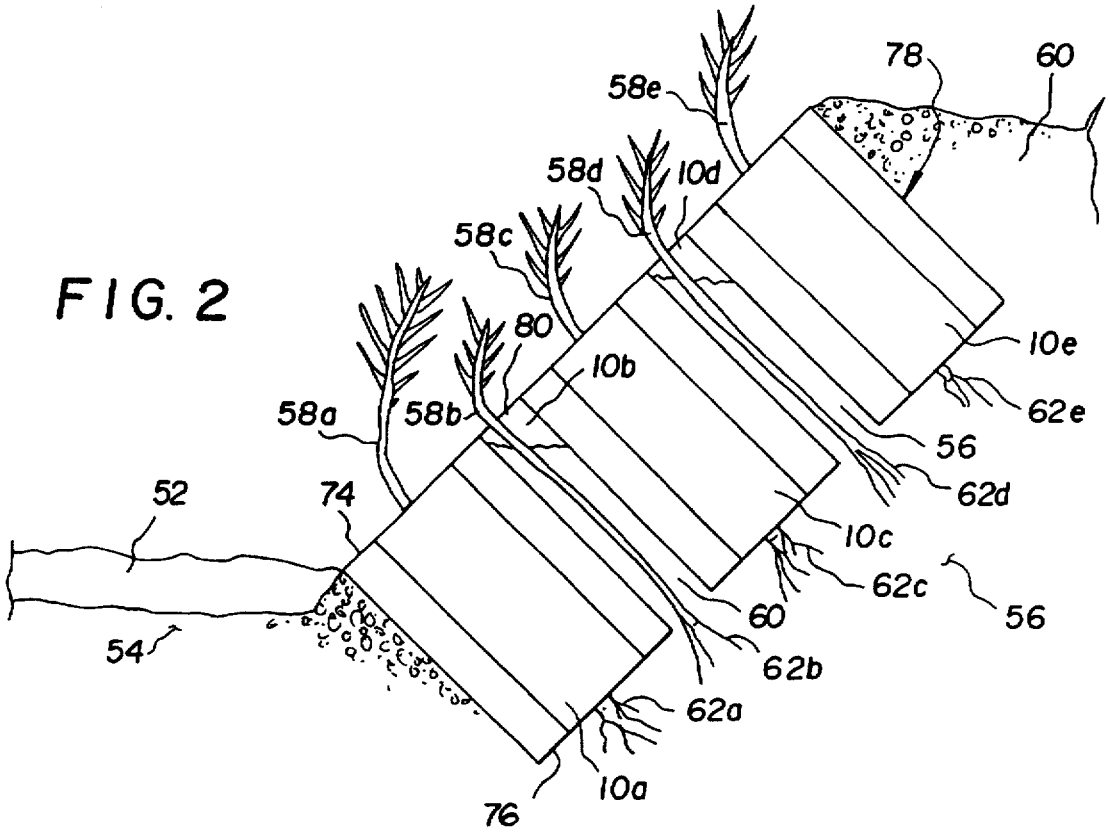
FIG. 2 is a side elevational view of a wall having a plurality of structures in position on a riverbank incline.

In use, the structures (10) and wall (78) are useful for controlling erosion of a dirt mass, for example a dirt incline (56) such as a riverbank (56). As best shown in FIG. 2, a river (52) has a riverbed (54) and a riverbank (56) (typically having inclines of for example 20 to 45 degrees, for example 30 degrees from the horizontal). The riverbank (56) is typically subjected to excessive erosion during high flow periods for the river (52). The present concrete wall (78) formed utilizes the present structures (10) for efficient and effective erosion control and also permits plant growth therefrom and therethrough. As shown in FIG. 2, plants (58*a, b, c, d, e*) are permitted to grow through the concrete wall (78) either through the hollow core (38) or through the (square) growth orifices (80) formed by adjacent structures (10) when the structures are in the nature of octagonal columns. Fill dirt (potting soil, soil) (60) may be positioned within the growth orifices (80) to ensure that the plants (58) growing therein have adequate soil. The soil (60) may also be positioned within the hollow cores (38) for ensuring adequate dirt for plant growth. As shown in FIG. 2, the plants (58) have roots (62*a, b, c, d, e*) which extend through the structures (wall) into the riverbank (56) for receipt of moisture and nutrients.

The structure (10) has a plurality of sides, for example 8 sides, when in the form of an octagonal column, and most preferably is in the form of an octagonal column having sides (72*a, b, c, d, e, f, g, h*). The structure also has an octagonal top (74) and an octagonal bottom (76) spaced apart therefrom (an parallel to) to provide a column structure having an octagonal cross-section and a circular hollow core formed by a (corrugated) pipe.

Figure 6:
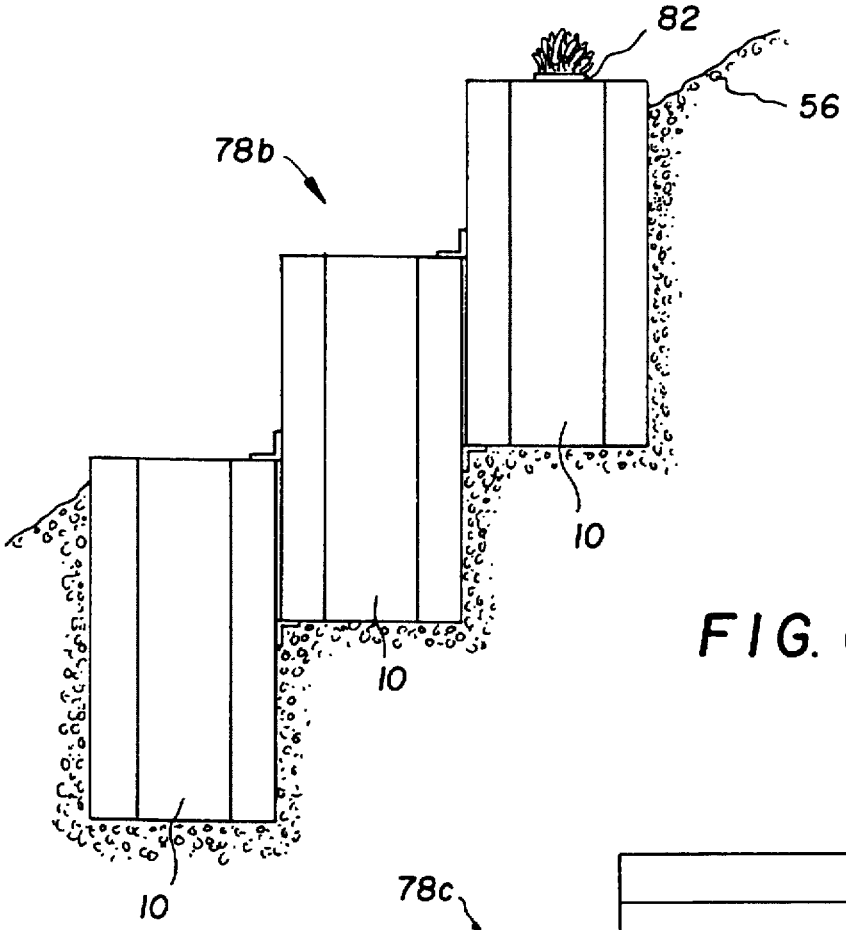
FIG. 6 is a side elevational view of the stair step wall of FIG. 5 positioned in a soil incline.
Figure 7:
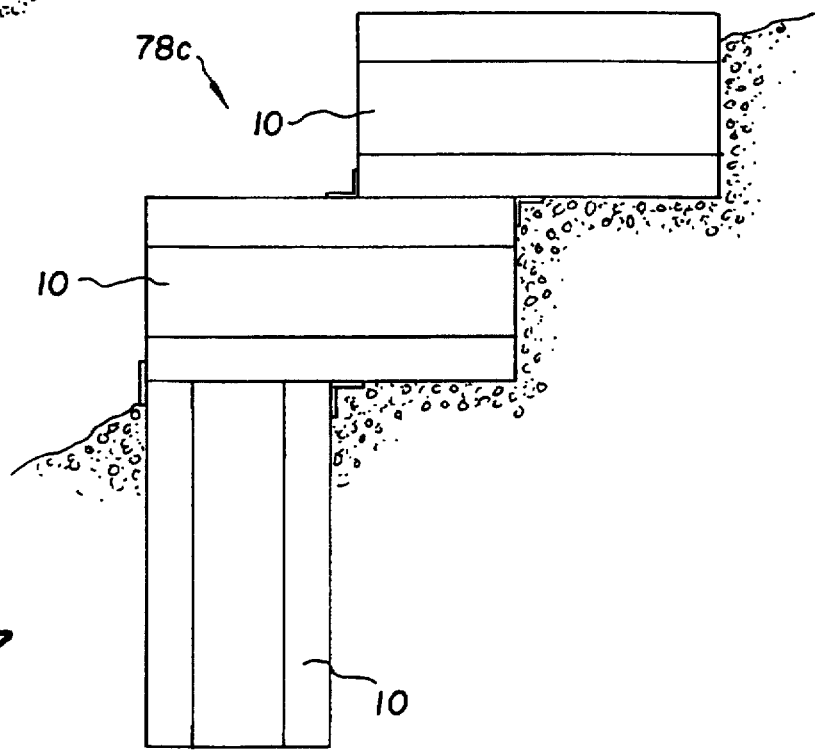
FIG. 7 is a side elevational view of an alternative embodiment of a wall according to the present invention positioned in a soil incline.

As shown in FIGS. 2, 6 and 7, the walls may be formed in various alternative orientations due to the shape of the octagonal column structures and the utilization of the welding elements to rigidly affix adjacent structures together. The structures are preferably tapered having a larger octagonal top than the octagonal bottom for permitting removal of a structure from a honeycomb wall in the event that a structure needed to be replaced (for example a width difference of an inch should facilitate easy removal from the wall). As shown in FIG. 7, an erosion-controlling wall (78) may be formed by positioning a first structure vertically at the base of the soil incline and substantially buried therein, a second column structure (10) in a horizontal orientation is positioned with a front portion overlaying the top of the first column for support thereon and is welded thereto and a third structure (10) is positioned horizontally above the second structure and overlays a least a portion of the second structure and is welded thereto to provide an inclined wall. Alternatively, as shown in FIG. 6, the column structures may be oriented vertically on the bank and positioned with the top of the lower structure (10) being positioned adjacent a weld element of a side of an upper structure to permit welding between the side and upper structure using an angle iron (an a welding system). Or alternatively as shown in FIG. 2 a wall of structures affixedly attached to each other may be formed by stacking the structures in an inclined fashion as shown in FIG. 2.

The present invention provides for the efficient and effective utilization of waste tires while also providing for efficient and effective erosion control and/or other gardening systems. The present system has numerous advantages over prior concrete tire systems including the ability to affix adjacent units to create a non-slipping rigid concrete wall which may be shaped in numerous orientations due to the utilization of plurality of weld units on the structures. Preferably the weld elements (angle irons) are positioned in pairs on the tops and bottoms and sides of the structures adjacent the intersections of the tops and sides thereof and adjacent to intersections of the bottoms of the sides thereof. Due to the circular shape of the cores (38) plants may be positioned in the cores by use of circular (cylindrical) buckets (for example 3 and 5 gallon buckets) (82) which may be easily inserted and removed as desired. The weld elements (36) may either be welded directly together or may be welded together using weld members (plates or weld angle irons) (68). The wall (78) may be various forms as shown by wall (78*a*) of FIG. 2, wall (78*b*) of FIG. 6 and wall (78*c*) of FIG. 7. The walls may be entirely covered with dirt if desired and may be used with sump pumps (not shown) if desired to remove excess water from the land side of the wall.

What is claimed is:

1. A reinforced earth stabilization structure compromising:

(a) an annular tire wall stack unit, (b) a reinforced concrete matrix shell encompassing the tire wall stack unit, and at least metallic weld unit located along a top end of said structure wherein said structure is in the shape of an octagonal column.

2. The structure of claim 1 wherein said structure has one octagonal end larger than another octagonal end.

3. The structure of claim 1 wherein said structure has a hollow core.

4. The structure of claim 1 wherein said stack unit comprises a plurality of compressed tire sidewall bundles.

5. A method for making an erosion control wall comprising:

(a) producing a reinforced or stabilization structure having an annular tire wall stack unit encased in a reinforced concrete matrix shell, said structure having an octagonal column shape and metallic weld elements on the surface of said structure, (b) Stacking a plurality of said structures on a dirt mass, (c) Welding adjacent structures together to form said wall.

6. A method for making a reinforced earth stabilization structure comprising, (a) providing an octagonal shaped mold having a central pipe extending centrally and upwardly from a base of said mold, (b) positioning a plurality of compressed tire walls over said pipe, (c) pouring fluid concrete over the tire walls to fill the wall with fluid concrete, (d) curing the concrete to form a structure, said method further comprising prior to pouring said concrete, positioning a plurality of angle irons within the mold to provide a final structure having portions of the angle irons exposed at the surface thereof and other portions of the angle iron imbedded within the concrete.

* * * * *